United States Patent [19]

Randell

[11] 4,284,242

[45] Aug. 18, 1981

[54] SPRAY HEAD

[75] Inventor: Arthur A. Randell, Tewkesbury, England

[73] Assignee: Coal Industry (Patents) Limited, London, England

[21] Appl. No.: 45,407

[22] Filed: Jun. 4, 1979

Related U.S. Application Data

[63] Continuation of Ser. No. 839,295, Oct. 4, 1977, abandoned.

[30] Foreign Application Priority Data

Oct. 8, 1976 [GB] United Kingdom ..... 41871/76

[51] Int. Cl.[3] ..... B05B 7/06

[52] U.S. Cl. ..... 239/422; 239/423

[58] Field of Search ..... 239/8, 291, 294, 416.4, 239/416.5, 417, 417.3, 420–424, 424.5, 425; 261/116

[56] References Cited

U.S. PATENT DOCUMENTS

| | | | |
|---|---|---|---|
| 431,479 | 7/1890 | Powell | 239/422 |
| 736,473 | 8/1903 | Arnold | 239/417.3 |
| 859,926 | 7/1907 | Dieckmann et al. | 239/417 |
| 1,002,594 | 9/1911 | Mason et al. | 239/416.4 |
| 2,072,375 | 3/1937 | McCallum | 239/422 X |
| 2,368,178 | 1/1945 | Turpin | 239/417 |
| 3,050,262 | 8/1962 | Curtis | 239/424 X |
| 3,276,694 | 10/1966 | Alexander | 239/422 X |

FOREIGN PATENT DOCUMENTS

| | | |
|---|---|---|
| 888540 | 1/1962 | United Kingdom . |
| 929440 | 6/1963 | United Kingdom . |
| 1038865 | 8/1966 | United Kingdom . |
| 1242342 | 8/1971 | United Kingdom . |
| 1360551 | 7/1974 | United Kingdom . |
| 1376637 | 12/1974 | United Kingdom . |
| 1388787 | 3/1975 | United Kingdom . |

*Primary Examiner*—Johnny D. Cherry

*Attorney, Agent, or Firm*—Stevens, Davis, Miller & Mosher

[57] ABSTRACT

A spray head suitable for spraying thickened colliery tailings onto a fluidized combustion bed includes a central aperture for the egress of gas directed towards and surrounded by an annular orifice for the discharge of the material to be sprayed. As the material issues forth in use from the orifice a gas flow from the central aperture impinges upon it to generate the spray the characteristics of which may be varied by altering the size and/or location of the central aperture. An annular aperture located around the orifice provides for the discharge of a gas in the form of a curtain which protects the head from excessive heat which might otherwise cause agglomeration of material on the head.

6 Claims, 3 Drawing Figures

SPRAY HEAD

This is a continuation of application Ser. No. 839,295 filed Oct. 4, 1977 now abandoned.

This invention relates to spray heads, and in particular, but not exclusively, to spray heads for use in spraying slurries.

It is often desirable to burn spoil from mining operations, particularly coal mining operations, to produce a usable product therefrom. Coal is generally separated from spoil by various washing and flotation techniques, and the spoil is usually collected as an aqueous slurry. It is now becoming the practice to burn colliery spoil, generally after thickening the slurry, in a fluidised bed combustor, in which a slurry of the spoil is pumped through spray heads into or onto a fluidised bed maintained at a temperature conducive to the combustion of the slurry.

The spray heads presently used have the following disadvantages. The heads have various restrictions in them which can often cause blockages in the supply of slurry feed and inefficient working of the combustor. It is necessary to pump the slurry at high pressure in order to obtain a combustible spray. The outer surfaces of the spray heads become coated with agglomerated slurry particles, which can greatly reduce the useful life of the spray head, and also causes restrictions in the spray head's discharge orifice, which reduces the amount of material sprayed into or onto the fluidised bed and thereby reduces the efficiency of the process.

It is an aim of the present invention to provide a spray head that will, at least in part, overcome the above mentioned disadvantages.

Therefore, according to a first aspect of the present invention, there is provided a spray head having at least two co-axial apertures, the inner or innermost aperture being directed towards the outer or intermediate aperture.

Conveniently three co-axial apertures are provided.

According to a second aspect of the invention there is provided a method of forming a spray comprising supplying, under pressure, to a spray head according to the invention a gas and a flowable material to be sprayed, such that the gas discharges through the inner or innermost aperture, the material to be sprayed discharges through the outer or intermediate aperture, and the gas from the inner or innermost aperture is directed into the material to be sprayed discharging from the outer or intermediate aperture, the characteristics of the spray thereby being variable.

When three apertures are provided, a gas is discharged through the third or outermost aperture to form a curtain of gas around the spray. The third or outermost aperture is utilised in situations where it is necessary or desirable to prevent deposition of agglomerates on the spray head. An instance of this is in fluidised bed combustion wherein the agglomerates may fall off the spray head and onto or into the bed, disturbing the properties of the bed and causing an increased yield of char or ash containing incompletely combusted material.

The inner or innermost aperture may be shaped so that it is directed towards the intermediate aperture. Advantageously the inner or innermost aperture is directed towards the outer or intermediate aperture by a baffle associated with the inner or innermost aperture. Preferably the baffle is movable axially relative to the inner or innermost aperture so that the size of the innermost aperture is variable.

The baffle is conveniently of the same cross sectional shape and approximately the same size as the inner or innermost aperture and may be tapered from its centre to its periphery, the taper defining an acute angle relative to the downstream axial direction. Alternatively the baffle may be spherical. The baffle should not substantially obstruct the outer or intermediate aperture. For instance the inner or innermost aperture may be defined by a cylindrical pipe, and the baffle may be a cylindrical or conical disc having substantially the same diameter as the pipe. If the baffle is conical, the apex of the cone should be located upstream of the base, and a hollow cone spray may be obtained. If the baffle is spherical, a solid cone spray may be formed.

The location of the inner or innermost aperture may be variable axially relative to the location of the outer or intermediate aperture. However if the location is not variable the location of the inner or innermost aperture should be fixed to give the desired spray characteristics.

The size of the outer or intermediate aperture will depend on the flow rate of the material to be sprayed and on the maximum particle size of any particulate matter in the material to be sprayed. It is an advantage of this invention that the material to be sprayed can be supplied to the spray head at low pressure and so the flow rate is not usually a limiting factor. It is therefore usual to define the size of the outer or intermediate aperture with respect to particle size. It is preferred that the size of the outer or intermediate aperture should be at least twice the diameter or largest dimension of the largest particle in the material to be sprayed. To ensure that this is so it is convenient to pre-screen the material to be sprayed. In this case there is very little possibility that the outer or intermediate aperture or the line supplying it with material to be sprayed will become obstructed.

Advantageously the outer or intermediate aperture is shaped so that the material to be sprayed is discharged therefrom at a desired angle relative to the axial direction.

A further advantage of the present invention is that any flowable material, such as very thick slurries, may easily be sprayed through the spray head of the invention since there is no necessity for high supply pressure in the line supplying the material to be sprayed to the spray head. In cases where the material to be sprayed is supplied at low pressure, the spray is mainly formed by the action of the gas discharging from the inner or innermost aperture into the material to be sprayed.

The third or outermost aperture, if present, is conveniently located upstream relative to the two inner apertures. Preferably the third or outermost aperture is shaped so that gas discharges from it at an acute angle relative to the downstream axial direction. The gas discharging from the third or outermost aperture forms a "curtain" around the spray and prevents the deposition of agglomerated material to be sprayed on the outer surfaces of the spray head, and thereby increases both the life and efficiency of the spray head. The third or outermost aperture may be of any desired size, but is usually relatively small compared to the size of the outer or intermediate aperture, since only gas discharges from the third or outermost aperture.

The spray head has connections through which the gas and material to be sprayed are supplied, and those may be any conventional connections and are not essential features of the invention.

Preferably the gas is air. It is also within the scope of the invention to supply different gases to the inner or innermost and third or outermost apertures.

The characteristics of the spray, such as the shape of the spray and the size of the droplets, are defined for the most part by the following nine parameters.

1. The rate at which the gas discharges from the inner or innermost aperture.
2. The size of the inner or innermost aperture.
3. The location of the inner or innermost aperture relative to that of the outer aperture or the two outer apertures.
4. The rate at which the material to be sprayed is supplied to the spray head.
5. The composition of the material to be sprayed.
6. The rate at which the gas discharges from the third or outermost aperture, if present.
7. The shapes of the inner or innermost and third or outermost apertures, and therefore the direction at which the gas is discharged therefrom.
8. The shape of the outer or intermediate aperture, and therefore the direction at which the material to be sprayed is discharged therefrom, although this only has a minor effect on the spray characteristics.
9. The relative location of the two outer apertures, when applicable.

For most applications of the present invention the parameters 7 to 9 are fixed once the spray head has been constructed, although these parameters can be altered by changing from a spray head of one design to a different spray head having a different design. It is possible in the normal use of the invention to vary the characteristics of the spray by varying parameters 1 to 6 either independently or in any combination. However parameter 6 is usually fixed, and although parameters 4 and 5 are variable their variation only plays a minor part in varying the characteristics of the spray.

Parameters 1 and 2 have a combined effect in that they define the velocity at which the gas discharges from the inner or innermost aperture, and this velocity, to a large extent determines the efficiency of forming the spray.

The shape of the spray is largely determined by parameter 3. If the inner or innermost aperture is located upstream of the outer or intermediate aperture, a conical spray having a small angle is formed. If the inner or innermost aperture is located downstream of the outer or intermediate aperture a flat spray is formed. In the latter case if there is no third or outermost aperture the spray may be directed upstream.

In a preferred embodiment of the invention the gas is air, and the material to be sprayed is an aqueous slurry of colliery spoil. The spray head is located above and spaced apart from a fluidised bed maintained in a condition conducive to the combustion of the spoil, and the spoil is sprayed onto or into the bed.

Although the invention is described hereinafter with reference to a fluidised bed combustor, it is to be understood that the present invention will find applications in many industries, particularly the chemical industry, wherein it is often necessary to spray slurries, for instance in spray drying processes.

The invention will now be described by way of example only, with reference to the accompanying drawings, in which.

Figure 1:
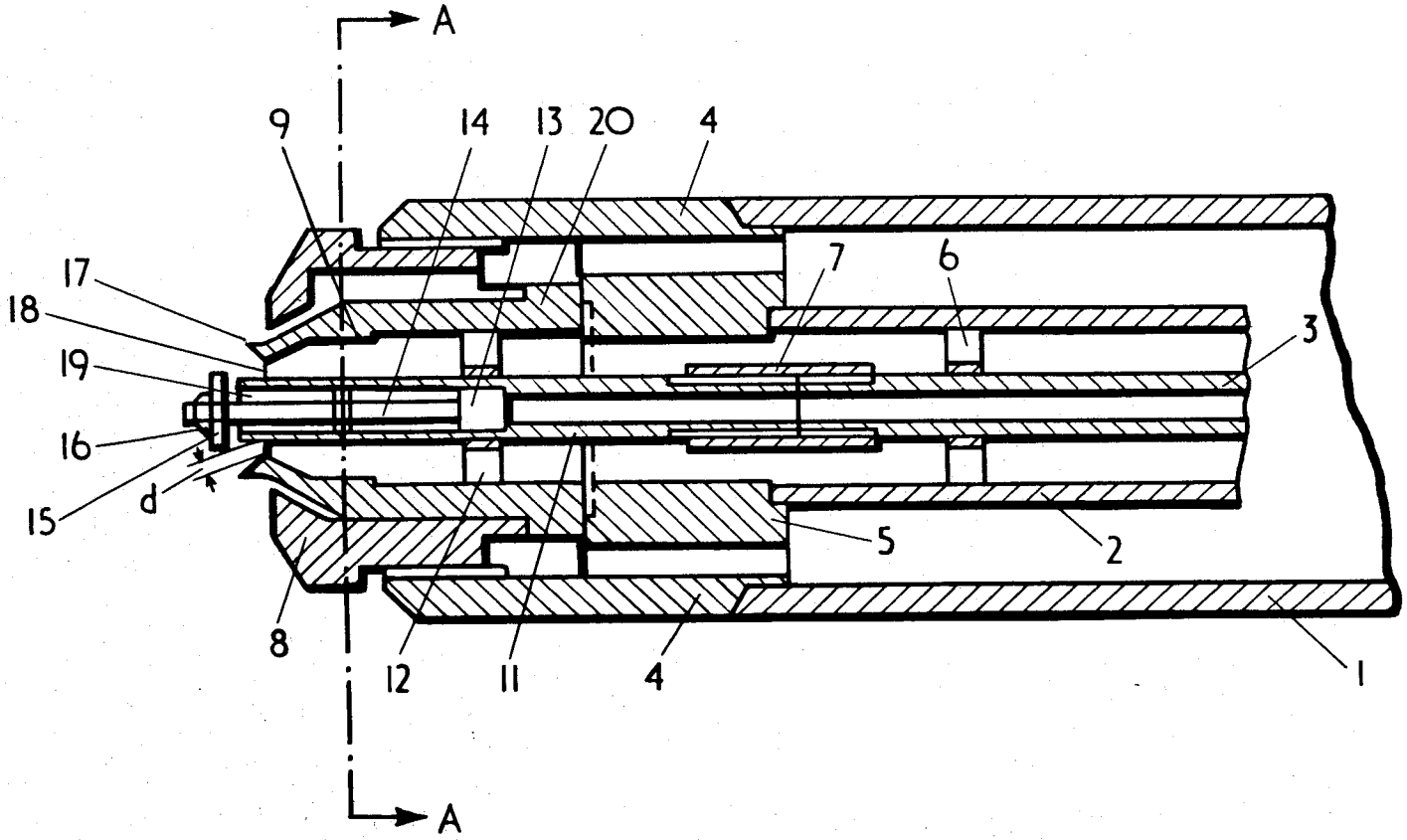
FIG. 1 shows a cross sectional side elevation of a spray head according to the invention.

Referring to FIG. 1, a spray head is fitted onto coaxial supply pipes 1, 2 and 3 for the supply of air, material to be sprayed, and air, respectively. An internally threaded outer sleeve 4 is welded onto the free end of supply pipe 1 and an annular stop 5 is welded onto the free end of supply pipe 2. Supply pipe 3, which is held in position by a spider 6, is externally threaded at its free end, and an internally threaded hollow cylindrical member 7 is screwed onto the external thread of supply pipe 3.

An externally threaded pipe 11 is screwed into cylindrical member 7. A Y-shaped piece 13 having a hollow internally threaded centre is welded inside pipe 11, and receives a rod 14 which is externally threaded at both ends. A baffle 15 is screwed onto the free end of rod 14 and is held in place by a locking nut 16.

A first annular member 9 having an external flange 20 at one end is disposed coaxially around pipe 11 and is kept in spaced relation therewith by a second spider 12, the flange 20 abutting the stop 5.

Figure 2:
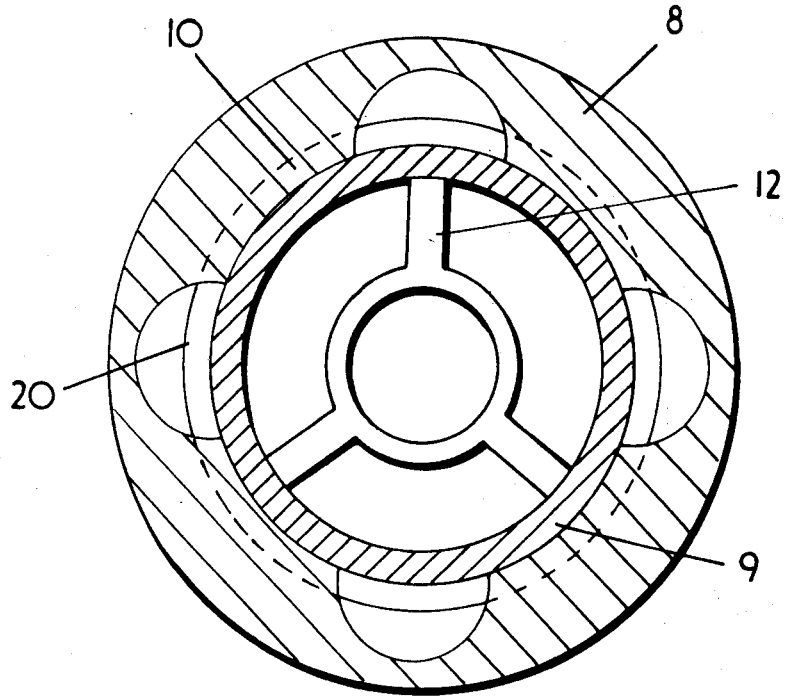
FIG. 2 shows a section along line A—A of FIG. 1 with some parts removed for the sake of clarity.

A second annular member 8, having four internal protrusions 10 and being externally threaded, is disposed coaxially around first annular member 9. The protrusions 10 are shaped on their inside to fit snugly over the first annular member 9 and to retain the two annular members 8 and 9 in spaced apart relation. The second annular member 8 is screwed into the outer sleeve 4 and when it is screwed in sufficiently the protrusions 10 engage with the flange 20 on the first annular member 9 and ensure that the first annular member 9 abuts the stop 5 tightly. The arrangement of the two annular members 8 and 9 is shown more clearly in FIG. 2.

Figure 3:
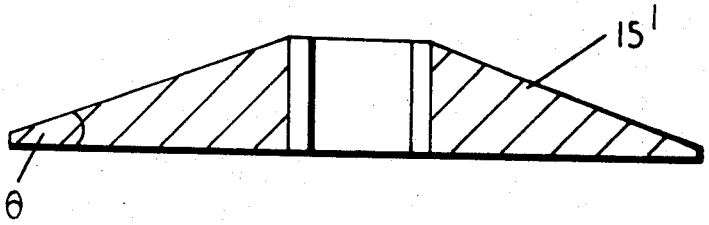
FIG. 3 shows an alternative form for the baffle of FIG. 1.

The two annular members 8, 9 define an outermost aperture 17, the second annular member 9 and the pipe 11 define an intermediate aperture 18, and the pipe 11 and baffle 15 define an innermost aperture 19. In this example the characteristics of the outer two apertures 17 and 18 cannot be varied. However the location and size of the innermost aperture 19 may be varied, by screwing the pipe 11 into or out of the cylindrical member 7, and/or by screwing the rod 14 into or out of the Y-shaped piece 13 respectively. The shape of the innermost aperture may be further varied by changing the baffle 15 as shown in FIG. 1 for a different baffle such as is shown in FIG. 3. FIG. 3 shows an alternative baffle 15[1], in the form of a conical disc having a fairly small angle $\theta$. The angle $\theta$ may be of any predetermined value and will give different spray characteristics accordingly. By varying $\theta$ it is possible to vary parameter 7 for the innermost aperture 19.

It is envisaged that in use the spray head will be located inside a fluidised bed combustor, over the bed and in spaced relation thereto. Air is supplied via supply pipes 1 and 3 to the outermost and innermost apertures 17, 19, and a slurry of colliery washery tailings, thickened in a deep cone thickener, is supplied via supply pipe 2 to the intermediate aperture 18.

The air is pumped through the outermost aperture 17 at a fixed rate so that deposition of material on the outside of the spray head is substantially prevented, and for this purpose the outermost aperture 17 is conveniently located upstream of the aperture 18.

The slurry of colliery washery tailings is pumped at such a rate that the velocity of the slurry in supply pipe 2 is greater than the "saltation velocity" of the particles in the slurry. The "saltation velocity" is the velocity at which the particles in the slurry begin to separate. Therefore at velocities greater than the "saltation velocity" there is substantially no danger of deposition of particles in the line and therefore blockages are substantially prevented. At present a spray having dimension d in FIG. 1 of approximately 5 mm can handle up to 3 tons to thickened colliery washery tailings per hour.

It should be noted that at whatever rate the slurry is pumped no positive spray is formed unless air is being pumped through the innermost aperture 19. When air is pumped through the innermost aperture 19, as it discharges it impinges on the slurry to form a spray. The spray in this case has a wide angle and is flat, thus distributing the tailings evenly over the bed and enabling efficient combustion to take place.

The characteristics of the spray in this embodiment are varied by varying the pressure at which air is pumped to the innermost aperture 19 and by varying the size and location of the innermost aperture 19 by the methods previously described.

I claim:

1. A spray head for forming a spray of flowable slurry material with a surrounding gas curtain comprising:

a. three concentric apertures comprising a first innermost aperture for discharge of a gas, a second intermediate aperture for discharge of flowable slurry and a third outermost aperture for discharge of gas in a curtain surrounding said slurry discharge;

b. the second intermediate aperture being shaped to direct the slurry discharging therefrom generally downstream;

c. the first innermost aperture having a baffle downstream thereof, the baffle being so positioned in relation to said first innermost aperture as to direct the gas discharging therefrom radially outwardly toward and to mix with the flow of slurry material;

d. the third outermost aperture being located radially outward of the first and second apertures and shaped to direct gas discharging therefrom outwardly at an acute angle relative to the dowstream axial direction so as to form a curtain around the slurry spray to prevent deposition thereof on the spray head.

2. A spray head according to claim 1 in which the baffle is positionable to vary the size of the aperture means.

3. A spray head according to claim 2 in which the baffle is a cylindrical disc.

4. A spray head according to claim 2 in which the baffle is a conical disc.

5. A spray head according to claim 1 in which the first innermost aperture is defined by the open end portion of a pipe, the pipe being movable whereby the location of the first aperture is variable.

6. A spray head according to claim 1 in which the third outermost aperture is located upstream of the first and second apertures.

* * * * *